United States Patent [19]

Dickinson

[11] 4,105,093

[45] Aug. 8, 1978

[54] CONTROL SYSTEM FOR PRESSURIZED LUBRICATING SYSTEM

[75] Inventor: John D. Dickinson, Springfield Township, Delaware County, Pa.

[73] Assignee: Westinghouse Electric Corp., Pittsburgh, Pa.

[21] Appl. No.: 765,340

[22] Filed: Feb. 3, 1977

[51] Int. Cl.[2] ..... F02C 7/06

[52] U.S. Cl. ..... 184/6.11; 60/39.08; 184/104 R

[58] Field of Search ..... 184/6.11, 6.1, 104 R; 60/39.08

[56] References Cited

U.S. PATENT DOCUMENTS

| | | | |
|---|---|---|---|
| 3,147,821 | 9/1964 | Eggenberger | 184/1 E |
| 3,626,693 | 12/1971 | Guillot | 184/6.11 |
| 3,722,212 | 3/1973 | Stein | 184/6.11 X |
| 3,722,624 | 3/1973 | Buckland | 60/39.08 X |
| 3,779,345 | 12/1973 | Barnes et al. | 184/6.11 X |
| 4,002,224 | 1/1977 | Easter | 60/39.08 X |

*Primary Examiner*—David H. Brown
*Attorney, Agent, or Firm*—G. H. Telfer

[57] ABSTRACT

A means for controlling compressed gas and lubricant pressure in a gas storage reservoir wherein the lubricant level in the gas storage reservoir will not vary due to changes in the gas pressure.

5 Claims, 1 Drawing Figure

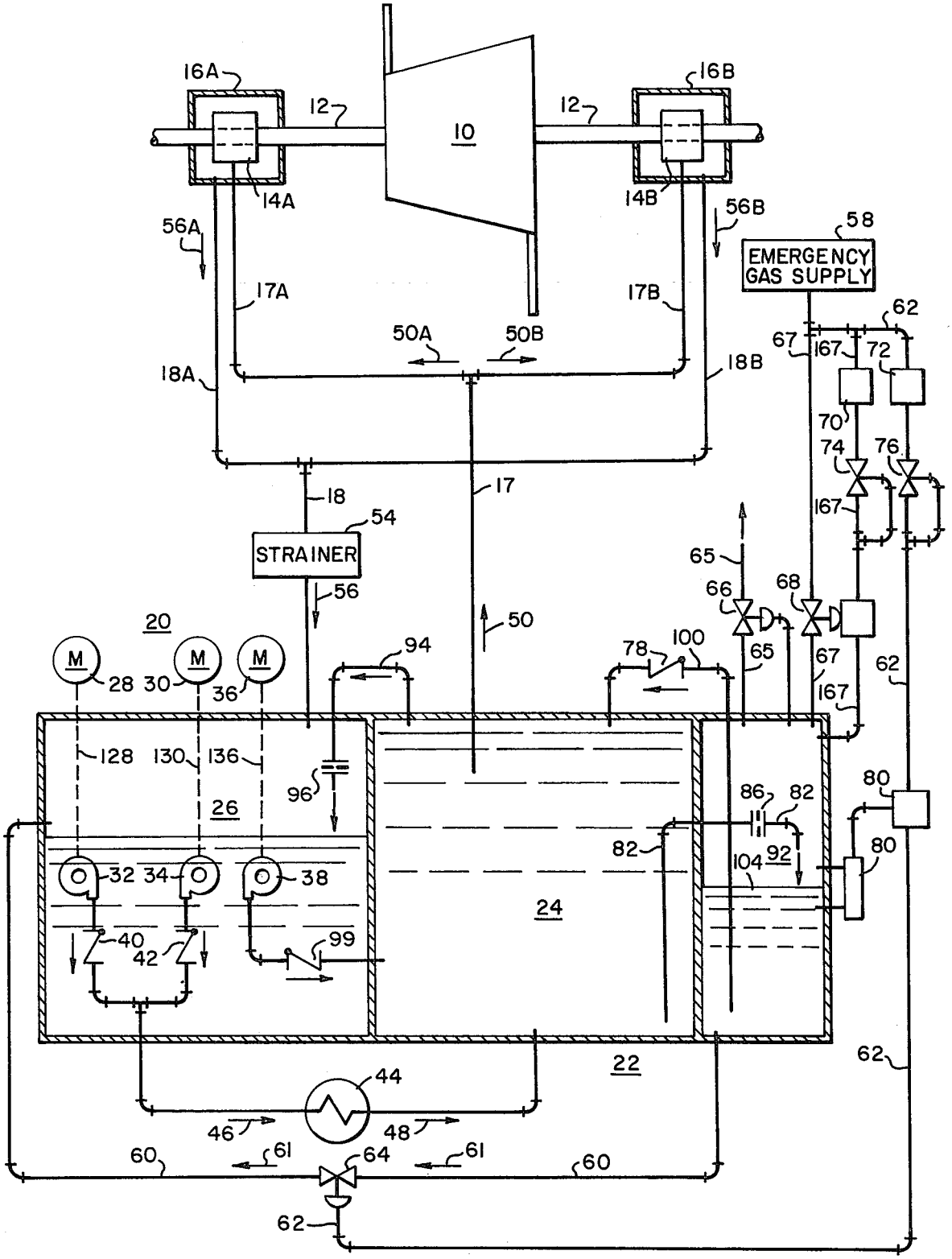
16A
16B
12
12
10
14A
14B
56A
56B
58
EMERGENCY GAS SUPPLY
17A
17B
62
50A
50B
67
167
72
18A
18B
70
74
76
18
17
167
54
STRAINER
65
56
66
68
20
50
94
78
100
65
67
62
M
M
M
28
30
36
167
128
130
136
96
86
82
80
26
82
92
80
32
34
38
104
24
40
42
99
22
62
44
46
48
60
61
64
61
60
62

CONTROL SYSTEM FOR PRESSURIZED LUBRICATING SYSTEM

BACKGROUND OF THE INVENTION

1. Field of the Invention

This invention relates to bearing lubrication systems and, in particular, to lubrication systems having a pressurized oil reservoir, an emergency gas system for backup flow capability, and a means for controlling the emergency gas system and the lubricant level at the gas fluid interface of such a system.

2. Description of the Prior Art

As is well known, large rotating apparatus, such as a turbine, have a rotor member extending centrally and axially therethrough and at each axial end of the rotor at a point exterior to the casing is provided a suitable bearing to rotatably support the rotor member. In order to assure that the bearings properly perform this function, it is of primary importance that they be supplied with a suitable lubricating fluid. For this purpose, the prior art has disclosed elaborate bearing lubricating fluid systems to supply the necessary lubricant to the bearings.

At present, there are several methods known to the art among which is a steam turbine lubricating system utilizing an oil pump mounted on the turbine rotor shaft as a device to provide lubricating oil under pressure to the turbine bearings. This shaft-mounted oil pump uses the kinetic energy of the rotor to provide an energy source independent of other interruptible power sources to convey fluid to the bearings. The shaft-mounted main oil pump provides motive oil to an oil ejector, which is located within a lubricating fluid reservoir. The discharge of the ejector supplies lubricating fluid under pressure to an oil cooler and then to the turbine bearings. A portion of the pressurized fluid at the discharge of the ejector is also supplied to the shaft-mounted pump suction to prime the shaft-mounted pump, i.e., to maintain a supply of fluid thereto.

After serving its lubricating system purpose within the bearing member, oil returns to the reservoir by gravity through a suitably disposed oil strainer. The reservoir itself is located a significant distance beneath the centerline of the turbine apparatus. All of the oil supply lines emanating from the reservoir to the bearings are surrounded by a guard pipe to insure that any leak developed within the fluid lines will drain to the oil reservoir. As a condition to this safety requirement, it is apparent that the reservoir itself must be of sufficient size to hold all the runback of oil of the entire system. Motor driven pumps are mounted on the reservoir and provide oil to the turbine bearing during those periods when the rotor is moving up to or coming down from rated speed.

Any oil lubricating system, the above-described being typical of a prior art embodiment, must meet three reliability conditions. A lubricating system must, first, provide oil to the bearing with minimal possibility of any interruption of oil supply; second, provide oil at a temperature cool enough to be utilized by the bearings; and, third, provide oil to the bearings that is not contaminated by foreign matter. In addition to the reliability conditions just outlined, it is desirable that a lubricating system be efficient so as not to overly detract from the efficiency of the entire power plant. With these requirements in mind, it is apparent that the prior art systems, although meeting the reliability requirements, do so at a cost to the overall efficiency of the power plant.

For example, although the prior art system is reliable, since the use of three pumps each powered by an independent power source reduces the probability that flow to the bearings will be interrupted, considerable power from the shaft-mounted pump is required in order to provide the necessary motive power to lift the lubricating fluid from the reservoir to the turbine bearings and also to the shaft-mounted pump suction. On a typical nuclear unit of 1200 mw, for example, such a turbine shaft-mounted pump requires 800 kw in order to provide motive oil for the lubrication functions. This reduces the overall efficiency of the turbine by 0.07%. As a further disadvantage, if the system utilizes an ejector to establish pressure of the oil flowing to the bearings, a limited discharge pressure is available due to the very nature of the ejector apparatus. Therefore, there is a limited range of distances that the reservoir may be located from the turbine, thus reducing overall power plant flexibility. Further, the motor driven pumps mounted on the reservoir may themselves require 75 to 100 horsepower to provide fluid to the bearings when they are called upon to do so.

A still further disadvantage in the prior art systems is the high temperature at which fluid is stored in the reservoir. The prior art maintains fluid in the reservoir at the drain temperature of approximately 150° F. In the event of loss of cooling water to the oil coolers located downstream of the reservoir, there is a possibility of damage to the bearings due to the introduction thereinto of hot oil. Also, the physical size of the conduits required by prior art systems occupies a greater portion of power plant area, this directly increases the cost of these facilities.

There is another disadvantage that is very evident in the case of turbines. For each turbine there also must be a new shaft mounted pump manufactured. The system as disclosed by this invention reduces engineering and mnaufacturing cost by utilizing commercially available motors and pumps, thus reducing the need for engineering, precision machining and other manufacturing cost.

It is apparent that an improved lubricating fluid system for the bearing of a turbine apparatus which eliminates these aforementioned problems of the prior art is desired.

In U.S. Pat. No. 4,002,224 an improved lubricating system was disclosed. This lubricating system comprises a lubricating fluid reservoir having therein a pressurized storage section and a nonpressurized drain section. Suitable pumping means, such as an electrically driven pump, is mounted on the reservoir and pumps fluid from the non-pressurized drain section, through an oil cooler, and into the pressurized section and to the bearings. Fluid discharged from the bearings is collected in the non-pressurized drain section and provides fluid to satisfy the pump suction. Provision of the oil cooler immediately upstream of the pressurized section maintains oil in storage at a cooler temperature than in the prior art.

An emergency backup system is provided to maintain bearing oil flow in the event of a system malfunction. The emergency system utilizes an external pressurized gas supply and provides pressure to maintain lubricant flow upon activation by a suitable mechanical control arrangement. In this embodiment, the gas and lubricating fluid are maintained isolated along a fluid gas interface within a separate section within the reservoir.

The prior art also discloses means for providing lubricant in the event the main pump means should be inoperative such as during deceleration. For example, in U.S. Pat. No. 3,147,821 a system was disclosed which utilized either compressed gas or gravity to provide lubricant in decreasing amounts during the deceleration period.

In United Kingdom Pat. No. 1,167,602, there is a backup hydraulic accumulator through which compressed gas forces lubricant to the bearings after detection of loss of pump pressure by means of a spring bias switch.

SUMMARY OF THE INVENTION

This invention provides a control system for lubricating bearings of a rotating shaft which satisfies all of the generally recognized reliability conditions in a manner that is efficient and overcomes the above-mentioned disadvantages of the prior art.

This invention controls a lubricating system which comprises a lubricating fluid reservoir having therein a pressurized storage reservoir, a non-pressurized drain reservoir and a gas storage reservoir. These units may be three independent reservoirs or three sections of one large reservoir. Suitable pumping means are provided to pump fluid from the non-pressurized drain reservoir into the pressurized reservoir, to the bearings and through a flow restraining device into the gas storage reservoir. In the preferred embodiments, the lubricant is pumped through a cooler located between the non-pressurized drain reservoir and the pressurized reservoir.

An emergency gas backup system is provided to maintain bearing oil flow in the event of a system malfunction. The emergency gas system utilizes an external pressurized gas supply and is filtered and applied to the gas storage reservoir.

The gas storage reservoir provides isolation of the fluid gas interface from the pressurized reservoir and is maintained through a pneumatical control means at a predetermined pressure, which must be less than the pressure of the lubricant in the pressurized reservoir.

The fluid level in the gas storage reservoir is maintained essentially constant. The lubricant is continuously supplied to the gas storage reservoir through an orifice device connected to the pressurized reservoir. A level control device which is designed to pneumatically open or close a flow control valve device will allow the return of excess lubricant to the non-pressurized reservoir. Thus a controlled level is maintained for lubricant at the gas fluid interface in the gas storage reservoir.

It is the object of this invention to provide a control system for a lubricating system that will insure that the lubricating system meets all of the reliability conditions of prior art systems in an efficient manner for lubricating the bearings of a large rotating shaft or rotor.

It is a further object of this invention to provide an emergency backup system to provide lubricating fluid in the event of system malfunction. It is yet a further object to provide an emergency backup system utilizing an external gas supply having a mechanical control arrangement associated therewith.

It is still a further object to control the air pressure in a gas storage reservoir at a pressure less than the pressure of the pressurized reservoir and to maintain a constant fluid level in the gas storage reservoir when the pumping means is operating properly.

BRIEF DESCRIPTION OF THE DRAWINGS

The invention will be more fully understood from the following detailed description, taken in connection with the accompanying drawing, in which the single FIGURE is a schematic view of a turbine bearing lubrication system embodying the teachings of this invention.

DESCRIPTION OF THE PREFERRED EMBODIMENTS

Referring to the drawing, a schematic view illustrating a lubrication system for the bearings of a large turbine apparatus is shown which uses one large reservoir 22 which is divided into three sections 26, 24 and 92. As seen from the FIGURE, a turbine 10 has a shaft 12 disposed centrally and axially therethrough. The shaft 12 is supported at each axial end thereof by bearing members diagrammatically illustrated at 14A and 14B. Each of the bearings 14A and 14B is supported within a suitable bearing housing 16A and 16B, which are connected to inlet conduits 17, 17A and 17B, and discharge conduits 18, 18A and 18B, all of which are associated with the lubrication system 20 which embodies the teachings of this invention.

The lubrication system 20 meets, in a manner to be more fully explained herein, each of the reliability conditions imposed by the steam turbine power generation art on lubrication systems in a manner that is more efficient than that exhibited by the prior art. Of course, as is known to those skilled in the art, to meet the reliability conditions, a lubrication system should: first, minimize the possibility of loss of lubricating fluid to the bearings under any operating condition regardless of failure of any system component or during any emergency condition; second, provide lubricating fluid at a temperature cool enough to prevent damage to the bearings thereby; and third, provide lubricating fluid to the bearings that is not contaminated by foreign particles which may deleteriously affect the bearing.

The system 20 shown in the drawing includes a lubricating fluid reservoir 22 having a pressurized section 24, a non-pressurized section 26 and a gas storage section 92. Mounted on the reservoir 22 above the non-pressurized section 26 are A.C. motors 28 and 30 which, respectively, provide power through drive shafts 128 and 130 for lubricating fluid pumps 32 and 34. For convenience, the pump 32 is designated as the main oil pump while the pump 34 is the auxiliary A.C. pump. In addition, a D.C. motor 36 associated with a standby pump 38 and drive shaft 136 is provided. Thus, there are three pump means with three independent power sources.

Oil, or other suitable lubricating fluid disposed within the non-pressurized section 26, is during normal operation, pumped by either the main oil pump 32 or auxiliary pump 34 through valving 40 or 42, depending upon whether the main pump 32 or auxiliary pump 34 is being operated, from the non-pressurized section 26 into an oil cooler 44, the flow being illustrated by reference arrows 46. Throughout the following discussion, it will be assumed that the main oil pump 32 is operative. It is understood that the auxiliary A.C. pump 34 is structurally similar in all respects to the main oil pump 32. Within the cooler 44, oil temperature is lowered to a predetermined level, being optimally stored at approximately 120° F. From the cooler 44, the oil is pumped under pressure, as illustrated by reference arrow 48, into the pressurized section 24. The pressurized section 24 acts as a pressurized source of fluid for the bearings 14A and 14B. Lubricating fluid moves to the bearings 14A and 14B within conduits 17, 17A and 17B from the pressurized reservoir 24 in accordance with flow arrows 50, 50A and 50B. The fluid stored within the pressurized section 24 is maintained at a predetermined pressure, such as approximately 40 p.s.i., due to the pump 32 during normal system operation. The fluid supplied from the pressurized section 24 enters the bearings at a lower pressure, such as approximately 15 p.s.i., due to pressure drops within the conduits 17, 17A and 17B. It is understood that the numerical values herein given are typical examples only, and that the precise operating pressure and temperature of the fluid stored within the pressurized section 24 is functionally dependent upon a variety of system parameters. Once given these parameters, of course, one skilled in the art may expeditiously arrive at the predetermined temperature and pressure values.

Fluid discharged from the bearings 14A and 14B returns through the conduits 18, 18A and 18B and through a strainer 54 in accordance with flow arrows 56, 56A and 56B into the non-pressurized section 26. Oil drained by gravity into the non-pressurized section 26 fills the suction of the main oil pump 32 to complete the lubricating fluid flow path to the bearings.

Fluid also flows from the pressurized section 24 through conduit 82 and orifice 86 into gas storage section 92. Level control device 80 senses the level of the gas fluid interface 104 and controls the gas flow through conduit 62 which communicates with flow control valve device 64.

Flow control device 64 controls the flow of the fluid through conduit 60 which is connected between the gas storage section and the non-pressurized section. Flow arrows 61 indicate the direction of flow.

An emergency gas supply 58 supplies gas into conduits 62, 67 and 167 and through filters 70 and 72 and regulators 74 and 76. Flow control device 68 senses the pressure in the gas storage section 92 and will control the flow into the gas storage section. Flow control valve device 66 is designed to ensure that the pressure in the gas storage section is less than the fluid pressure in section 24 by opening and allowing excess pressure to bleed off. Regulator 76 regulates the gas flow to level controller 80. Controller 80 regulates gas flow through conduit 60 and flow control valve device 64. Conduit 100 connects gas storage section 92 with the pressurized section 24 with check valve means 78 interposed therein to prevent flow when the fluid pressure in section 24 is greater than the pressure in section 92.

As may be appreciated from the foregoing, the system 20 above-described meets all three of the reliability conditions and is an improvement over the prior art. Since the pumps 32 and 34 are mounted on the reservoir 22, less energy is required to provide lubricating fluid for the pump suctions than in the prior art. In the prior art utilizing a turbine shaft-mounted pump, energy is required to both lift oil to the bearings and also to lift oil from the reservoir to supply the shaft-mounted pump section. With the system embodying the teachings of this invention, however, energy is expended only to lift oil from the reservoir to the bearings, thus making the system described herein more efficient than the prior art. And, since the main and auxiliary pumps 32 and 34 are both A.C. motor driven and are used in the system without an oil ejector, a further increase in efficiency is derived over the shaft-mounted pump system used with an ejector which was used in the prior art.

As stated earlier, due to the disposition of the pressurized storage section 24 and gas storage section downstream relative to the oil cooler element 44, lubricating fluid is stored within the both sections at approximately 120° F. The prior art, which locates the single section, unpressurized oil storage reservoir upstream of the cooler, stores oil at approximately bearing drain temperature, or 150° F. This difference in storage temperature between the system disclosed herein and the prior art directly relates to the second reliability condition, in that the oil is supplied to the bearings at a suitable temperature under all operating conditions. Storing of lubricating fluid at the lower temperture has an advantage in that it provides a useful heat sink in the event of damage or malfunction of the oil coolant system.

In operation, on initial starting of the system, lubricating fluid is pumped by the main oil pump 32, through its associated check valve 40 from the non-pressurized storage section 26 to the pressurized section 24. As explained in connection with the drawing, the temperature of the fluid is lowered to its predetermined storage temperature of approximately 120° F by the oil cooler 44 disposed upstream of the pressurized storage section 24. As the level of oil rises within the pressurized section 24, air which is trapped and compressed within the pressurized section 24 as the fluid is introduced therein and which would offer opposition to the continued introduction of lubricating fluid, is vented from the pressurized section 24 through a suitably provided vent 94. The vent line 94 has an orifice 96 therein, and extends from the pressurized section 24 into the nonpressurized section 26.

As the lubricating fluid fills the entire pressurized section 24, some leakage through the vent line 94 and the orifice 96 occurs. However, the orifice 96 is sized such that leakage of fluid from the pressurized section 24 is of a magnitude that does not permit depressurization of the fluid within the pressurized section 24.

Also conduit 82 allows the fluid to flow into the gas storage section 92 through orifice 86. Orifice 86 is sized such that fluid is allowed to flow into the gas storage section and maintain a pressure different between the gas storage section and the pressurized section.

As explained above, the lubricating fluid is stored within the pressurized section 24 at approximately 40 p.s.i., and is pumped to the bearings at 15–20 p.s.i. to supply the lubrication requirements thereof. Throughout the normal operating cycle, the flow of fluid to the bearings proceeds as described. However, if any interruption of pump power 32 occurs, a system meeting the first reliability condition is provided for the continued flow of lubricant.

In general, if a malfunction of the main oil pump 32 occurs, the auxiliary pump 34 stands ready to maintain oil flow to the bearings. And, if A.C. power to both these pumps is interrupted, there is available the D.C. pump 38, which will pump lubricant through valve means 99 into section 24. Even though the reliability of such backup power supplies is good, there is required some finite time interval between the failure of A.C. power and the restoration of flow by D.C. powered-pumps. A severe problem may occur, however, due to the flow requirements for the turbo-machinery utilized in modern power generating facilities. To provide the lubricating fluid flow required for the turbo-machinery for even the matter of seconds needed to initiate D.C. power is a difficult task. The emergency gas system embodying the teachings of this invention maintains lubricating fluid flow to the bearings, thus preventing flow interruption in the event of loss of pump power.

The emergency gas system 58 shown operates as follows: The controller for control valve 68 is preset at some predetermined value, commonly some pressure a predetermined amount below the storage pressure. As an example, if the storage pressure is 40 p.s.i., the regulator is set at 35 p.s.i. The pneumatic control valve is of the diaphragm operated type and the controller mounted on the valve senses the pressure in the gas storage section 92 and compares this pressure to the preset value of, for example, 35 p.s.i.

If the pressure in section 92 is less than the set pressure, then the valve controller will cause flow control valve 68 to increase the gas flow into conduit 67 into section 92 until the pressure in section 92 equals the pressure setting of the control valve 68.

Conduit 65 is connected to the valve controller 66; valve controller 66 has an adjustable spring bias which allows the setting of a reference point that is set to correspond to a pressure between the pressures in sections 24 and 92, i.e., using the previous figure this setting should be 37.5 p.s.i.

Upon the occurrence of the pressure in section 92 exceeding the reference setting of valve 66, the valve 66 will open venting section 92 through conduit 65 into the surrounding environment or an existing vent system.

The system used to control the fluid level in section 92 insures that the fluid level is maintained within close tolerance thereby limiting the liquid volume changes in section 92 so that the air control system remains stable. Also, because there will be some flow from section 24 through conduit 82 and orifice 86 into section 92, the fluid temperature in section 92 will be approximately equal to, under normal operating conditions, the precool temperature of the fluid in section 24.

When the main pump or an auxiliary pump is operating, the pressure generated by the pumps forces a restricted flow of fluid through conduit 82 and orifice 86, into section 92.

The orifice allows the pressure in section 24 to be greater than the pressure in section 92. The size of the orifice can be determined by one skilled in the art when given the system parameters.

Conduit 62 connects the compressed gas source 58 to filter 72 which removes any foreign particles out of the gas. Regulator 76 is connected to the filter 72 by conduit 62 and regulates the air pressure for operating the air-pilot actuated float level controller 80. Conduit 62 connects the level controller 80 to the regulator 76.

The level controller 80 senses the level of the fluid in section 92 and in the event the level exceeds the established level it will cause the gas pressure in conduit 62 to increase. When the pressure in conduit 62, which is connected to spring bias control valve 64 increase beyond the spring bias setting, flow control valve 64 will open and allow the fluid to drain from section 92 through conduit 60 into non-pressurized section 26. Thus the fluid level is prevented from exceeding a predetermined level.

The level controller and flow control valves that are referred above are for discussion only and any of several types of readily available units which are known to one skilled in the art and may be substituted in their place.

When an interruption of pump pressurization occurs, the pressure of the lubricating fluid in the pressurized section 24 decreases. The regulated compress gas within the gas storage section 92 expands, forcing the check valve means 78 to open maintaining oil flow. Thus, a flow of pressurized gas from the gas storage section 92 applies pressure to the gas fluid interface forcing lubricant through the pipe 100, causing check valve 78 to open, and flow into the pressurized fluid section 24 occurs. The pressurized gas exerts a force on the oil remaining in the storage section 92 to insure that the flow of lubricating fluid to the bearings is continued. The pressure from the compressed gas source will maintain flow for sufficient time to permit the startup of the backup D.C. pump. Upon startup, of the backup pumps, either pump 34 or 38, the pressurized storage section 24 is again pressurized and section 92 is again refilled with lubricant as discussed earlier.

While preferred embodiments of the invention have been described herein, changes may be made thereto without departing from the spirit of the invention as described in the appended claims.

I claim:

1. A method of supplying lubricant to a bearing means supporting a rotating shaft for a predetermined period of time when a primary system for applying lubrication to a bearing means is inoperative, which method comprises the steps of:

maintaining a pressurized reservoir of lubricant with a capacity large enough to supply lubricant to the bearing means for the predetermined period of time;

supplying lubricant from said pressurized reservoir to a gas storage reservoir;

maintaining said gas storage reservoir at a pressure, under normal operating conditions, less than a pressure in said pressurized reservoir, and said gas storage reservoir having a gas-lubricant interface therein;

sensing when there is a malfunction by the pressure in said pressurized reservoir being less than the pressure in said gas storage reservoir, and supplying lubricant to the bearings means for the predetermined period of time when the pressure in said pressurized reservoir is less than the pressure in said gas storage reservoir.

2. The method as claimed in claim 1 further comprising:

maintaining the lubricant level in said gas storage reservoir within predetermined limits.

3. An emergency lubrication system for applying lubrication to a bearing means for a rotating shaft during the period of time when a primary lubrication system is inoperative comprising:

a primary lubrication means including a pressurized reservoir, a supply conduit for supplying lubricant to said bearing means, a non-pressurized collection reservoir, a return conduit providing a return path for said lubricant from said bearing means to said non-pressurized collection reservoir, and a pumping means for maintaining a first predetermined pressure in said pressurized reservoir;

a gas storage reservoir;

a pressure maintaining means for maintaining a second predetermined pressure in said gas storage reservoir that is less than said first predetermined pressure in said pressurized reservoir when said pumping means is operative;

a pressure sensing and lubricant transfer means including a check valve means, an emergency flow conduit connecting said gas storage reservoir with said pressurized reservoir having said check valve means disposed in line therein between said gas storage reservoir and said pressurized reservoir whereby, upon the loss of said first predetermined pressure, said check valve means opens and allows fluid communication between said gas storage reservoir and said pressurized reservoir thus allowing said second predetermined pressure to expand and force the lubricant in said gas storage reservoir to flow into said pressurized reservoir through said emergency flow conduit and the lubricant in said pressurized reservoir to flow through said supply conduit lubricating said bearing means for a predetermined period of time.

4. The invention as claimed in claim 3 wherein said pressure maintaining means further comprises:

a source of high pressure gas;

a gas conduit means for connecting said source of high pressure gas to said gas storage reservoir;

a control means cooperatively associated with said source of high pressure gas for introducing said high pressure gas into said gas storage reservoir when the pressure in said gas storage reservoir drops lower than said second predetermined pressure;

a vent conduit means;

a vent valve device means disposed within said vent conduit means; and a back pressure regulator means cooperatively associated with said vent valve means whereby when said pressure within said gas storage reservoir exceeds said second predetermined pressure said vent valve means opens and permits communication between said gas storage reservoir and said vent conduit means.

5. The invention as claimed in claim 3 including further a means for maintaining a fluid gas interface at an essentially constant predetermined level within the gas storage reservoir and comprising:

a flow restrictive means;

a flow conduit means for connecting said pressurized reservoir to said gas storage reservoir with said flow restrictive means connected in line with said flow conduit means such that lubricant may be supplied to said gas storage reservoir from said pressurized reservoir while maintaining said first predetermined pressure greater than said second predetermined pressure;

a dump valve means;

a dump conduit means; and a level control means which senses the level of said fluid gas interface in said gas storage reservoir and communicating with said dump valve means mounted in line with said dump conduit means connected between said gas storage reservoir and said non-pressurized collection reservoir, whereby the level of said fluid gas interface in said gas storage reservoir is prevented from exceeding said constant predetermined level by the opening of said dump valve means.

* * * * *